United States Patent [19]

Raudat et al.

[11] 4,075,819

[45] Feb. 28, 1978

[54] FINGER ASSEMBLY FOR PACKER GRID

[75] Inventors: John L. Raudat, North Madison; Lloyd D. Johnson, Portland, both of Conn.

[73] Assignee: Emhart Industries, Inc., Farmington, Conn.

[21] Appl. No.: 775,669

[22] Filed: Mar. 8, 1977

[51] Int. Cl.[2] ..... B65B 39/02

[52] U.S. Cl. ..... 53/248; 53/262

[58] Field of Search ..... 53/166, 247, 248, 262

[56] References Cited

U.S. PATENT DOCUMENTS

| | | | |
|---|---|---|---|
| 3,788,034 | 1/1974 | Hartness et al. | 53/248 |
| 3,908,339 | 9/1975 | Kennedy et al. | 53/262 X |
| 3,911,647 | 10/1975 | Hartness et al. | 53/262 X |
| 4,033,095 | 7/1977 | Wild | 53/248 |

*Primary Examiner*—Robert Louis Spruill

*Attorney, Agent, or Firm*—H. Samuel Kieser

[57] ABSTRACT

A finger assembly for use in a packer grid wherein the finger assembly comprises a body having an upper frustoconical section having at least one flat thereon. At least one flexible finger extends downwardly and outwardly from the body. The finger includes an upper portion which is positioned against the flat. The upper portion also includes at least one ear. A cap is attached to the upper portion of the body and holds the upper portion of the finger against the flat. The cap also includes a circumferential groove in its interior surface into which the ear extends to prevent withdrawal of the finger when the cap is tightened.

10 Claims, 5 Drawing Figures

FINGER ASSEMBLY FOR PACKER GRID

BACKGROUND OF THE INVENTION

The present invention relates to an improved finger assembly for a packer grid and to a packer grid utilizing the improved finger assemblies.

The packer grid of the present invention is of the type used in connection with machines for packing bottles, cans and other articles into cellular containers which may take the form of wood or cardboard cases having compartments or cells for individually holding the bottles or the like. The grid controls and directs the gravity fall of charges of bottles or the like into the compartments or cells of the cellular container.

One problem in grid design is to make a grid that is adjustable in all directions within a given range. It is desirable that the grid be adjustable for varying pack patterns, such as three bottles by four bottles or four bottles by six bottles, as well as for different bottle diameters.

In addition, after long operation or jams in the grid area, it is possible that one or more of the flexible fingers of the grid may become broken or damaged. In such a case, it is desirable that the finger be readily replaceable either by replacement of an individual finger assembly, or by replacement of the finger itself while the finger assembly is still mounted on the packer.

SUMMARY OF INVENTION

Accordingly, the present invention has for its object the provision of an improved finger assembly for a packer grid wherein the finger assembly is easily adjusted to vary the size of the grid.

Another object of the present invention is the provision of a finger assembly for a packer grid wherein an individual finger is readily replaceable.

DESCRIPTION OF THE DRAWINGS

These and other objects and advantages of the present invention will be more readily understood by reference to the following detailed description and to the accompanying drawings in which.

DETAILED DESCRIPTION

Figure 1:
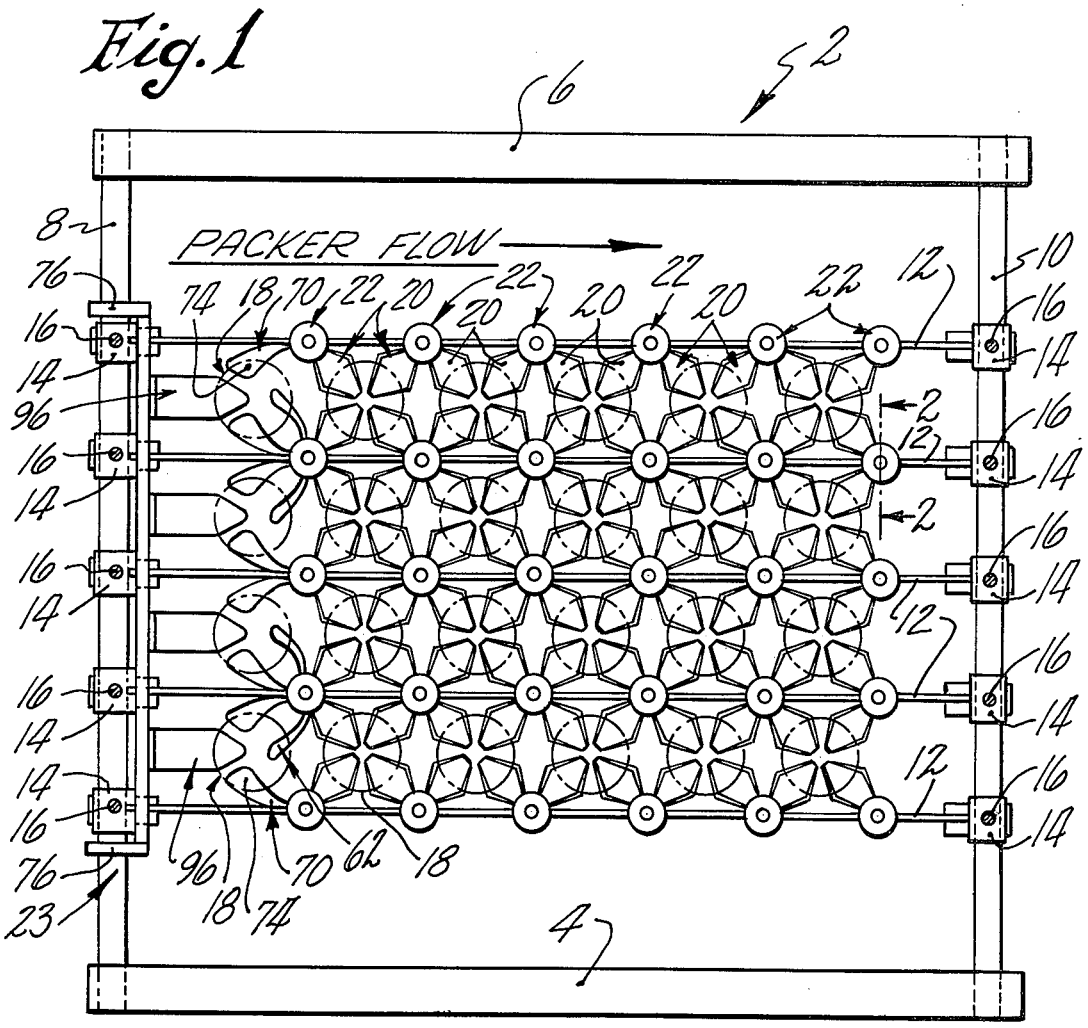
FIG. 1 is a top plan view of a packer grid utilizing the finger assemblies of the present invention.

Referring to the drawings, and particularly to FIG. 1, the packer grid 2 includes a frame comprising two spaced apart side plates 4 and 6 and spaced apart upstream and downstream rods 8 and 10 having their opposite ends connected to the side plates 4 and 6 respectively. A plurality of spaced apart mounting bars or strips 12 extend generally parallel to the side plates 4 and 6 between the two sides plates 4 and 6. Each bar 12 has each end attached to a collar 14 which in turn is slidably mounted on either the upstream or downstream rod 8 or 10 as shown in the drawing. A set screw 16 may be provided with each collar 14 to lock the collar 14 in place after it has been moved into proper position. The bottle receiving channels or funnels 18 are defined by a plurality of downwardly and inwardly extending flexible fingers 20 which are part of either a finger assembly 22 or a front finger mount 23. The finger assemblies 22 are mounted on the spaced apart strips 12 while the front finger mount 23 is attached to the upstream rod 8.

Each finger assembly 22 includes a body 24 having a cap 26 attached to the upper end thereof. The fingers 20, which may be fabricated from any suitable flexible material such as nylon or the like, are clamped between the cap 26 and the upper portion of the body 24. The finger assembly 22 also includes a retainer disc 28 attached to the lower portion of the body 24 by means of screws 30.

Figure 3:
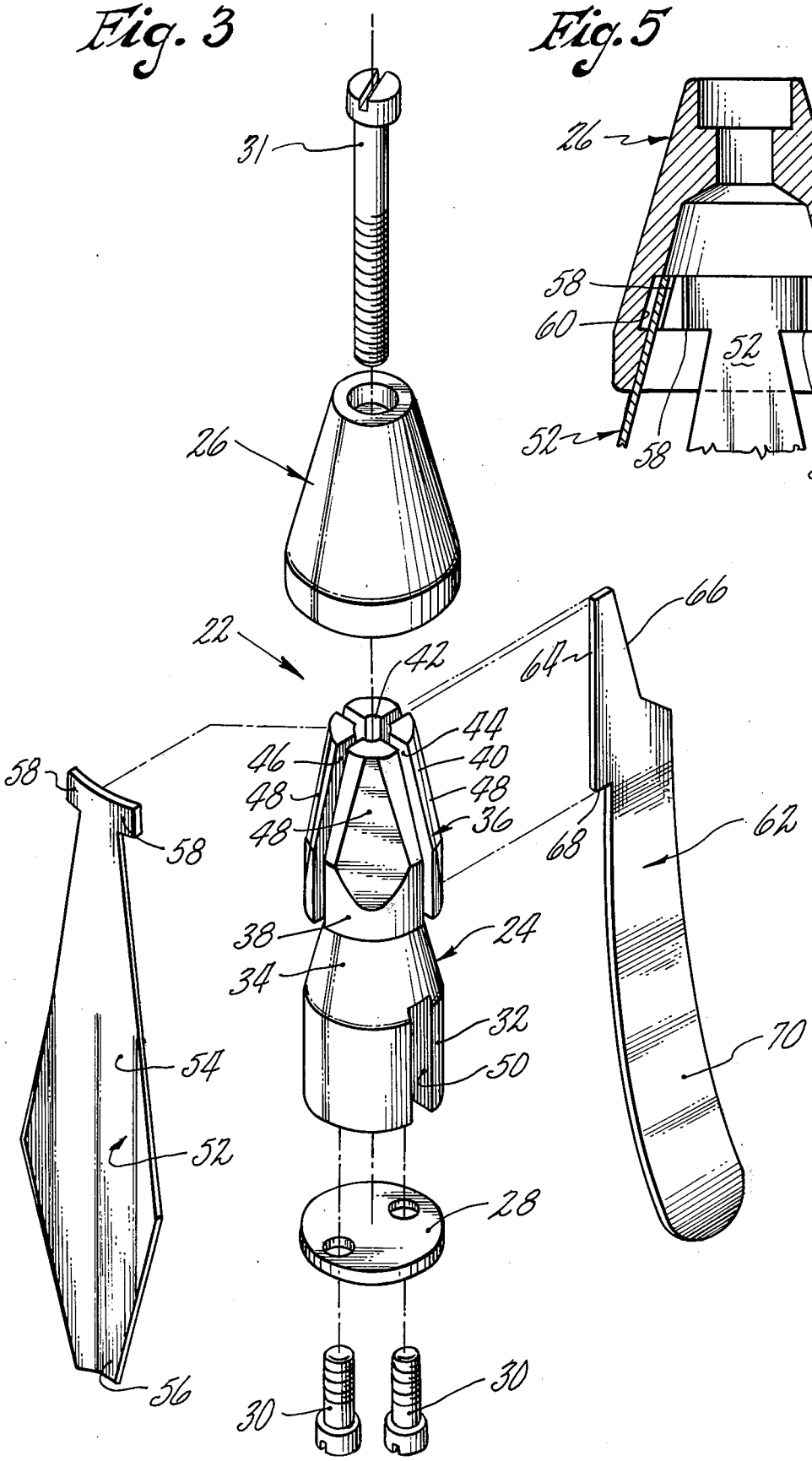
FIG. 3 is an exploded view of the various components of an individual finger assembly.
Figure 5:
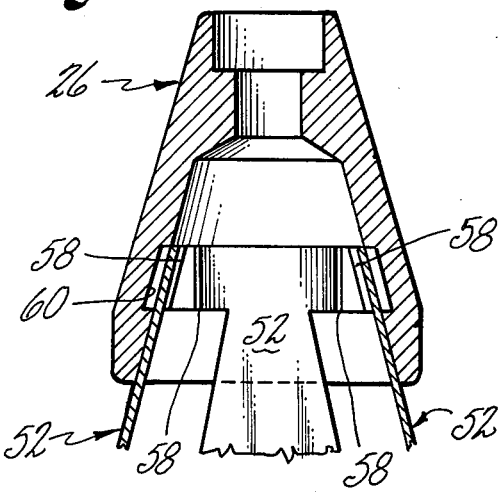
FIG. 5 is an enlarged view partially in section showing how the upper portion of the individual "corner" fingers fit within the cap of the finger assembly.

The body 24 of the finger assembly 22 includes a bottom generally cylindrical section 32, a frustoconical midsection 34, the larger diameter of which is connected to the bottom section 32, and an upper section 36. The upper section 36 includes a lower generally cylindrical section 38 and an upper frustoconical section 40, the smaller diameter of which is at the top. A central bore 42 is provided through the body 24 coincident with its axis. The bore 42 is internally threaded in the region of the frustoconical midsection 34. As shown particularly in FIG. 3, the upper section 36 is provided with two slots 44 and 46 which intersect each other at a 90° angle and which divides the upper section 36 into four parts. The slots 44 and 46 extend diametrically across said upper section. A flat or land 48 is provided on each of the four parts of the upper section as shown in FIG. 3. The bottom section 32 includes one slot 50 extending diametrically across the bottom section 32 and having a midplane coincident with the midplane of one of the slots 44 or 46 in the upper section 36.

Figure 2:
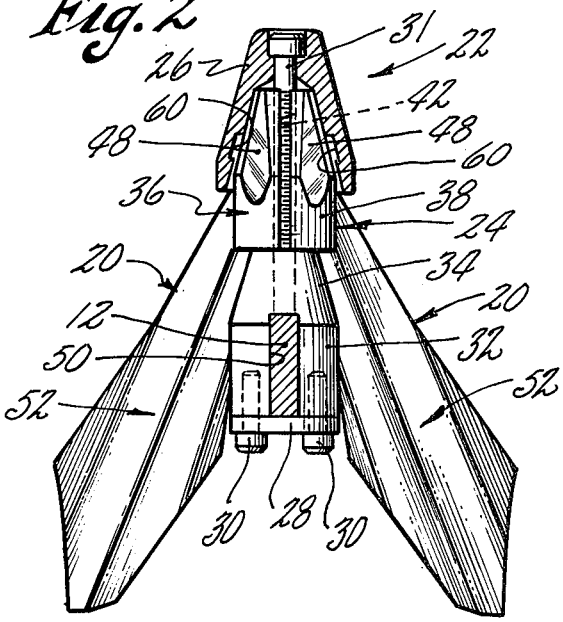
FIG. 2 is an enlarged sectional view taken in the direction of the arrows 2—2 of FIG. 1.

The finger assembly 22 may be used for mounting fingers 20 of varying configuration. One such finger design which is shown in FIGS. 2 and 3 may be termed a "corner" fingers as it defines a corner of the bottle receiving channel or funnel 18. This finger 52 includes a generally diamond-shaped body portion 54 which is concave in both a transverse and longitudinal direction. The bottom end of the body 54 may be provided with a flat edge 56. The upper end may be provided with a pair of oppositely disposed ears 58 as shown in FIG. 3, thus forming a generally T-shaped upper end.

For the purpose of mounting the "corner" finger 52 on the finger assembly 22, the cap is provided with a circumferentially extending groove 60 in its internal surface. As shown in FIG. 2, the internal surface of the cap 26 is of a frustoconical configuration which mates with the upper section 40 of the body 24. In assembling the "corner" finger 52, the upper end of the finger 52 is placed against one of the lands 48 with the concave face of the finger 52 facing away from the body 24. The cap 26 may be placed over the upper end of the body 24 of the finger assembly 22 and upper end of the fingers 52. When the cap 26 is tightened against the upper end of the body 24 by the screw 30, the ears 58 will extend into the groove 60 in the cap 26 and prevent withdrawal of the finger 52 from the assembly.

Another type of finger which may be used with the finger assembly 22 is indicated by the reference numeral 62 in FIG. 3 and includes an upper portion having inner and outer edges 64 and 66 which are angularly disposed with respect to each other, and a shoulder 68. The finger 62 may be attached to the body 24 by inserting the upper portion into the end of one of the slots 44 or 46 in the upper section 36 of the body 24 so that the inner edge 64 is substantially parallel to the wall of an intersecting slot and the outer edge 66 is parallel to the outer wall of the upper frustoconical section 40. With this arrangement, the shoulder 68 abut against the top of the frustoconical midsection 34 and prohibit withdrawal of the finger 62 from the assembly when the cap 26 is in place. The finger 62 may be of the type which includes a body portion 70 which extends downwardly, outwardly and forwardly from the body 24 when mounted as shown in FIG. 2. Another type 72 of finger 20 which may be used in the finger assembly 22, is shown generally in FIG. 1 and includes an upper section similar to that described in connection with finger 62 and thus is mounted in the end of a slot 44 or 46 in the body 24. The finger 72 includes a relatively wide body portion 74 which extends generally downwardly, forwardly and to the side of the body 24 of the finger assembly 22 as shown in FIG. 2. The width of the slots 44 and 46 in the body 24 of the finger assembly 22 should be sufficient to permit the mounting of two fingers in each end of one slot.

The finger assembly 22 is mounted on the grid 2 by inserting the body 24 onto a strip 12 so that the strip 12 is positioned in the slot 50. The retainer disc 28 is attached to the lower end of the body by the screws 30 as shown in FIG. 2, whereby the finger assembly 22 is firmly held on the strip 12.

Figure 4:
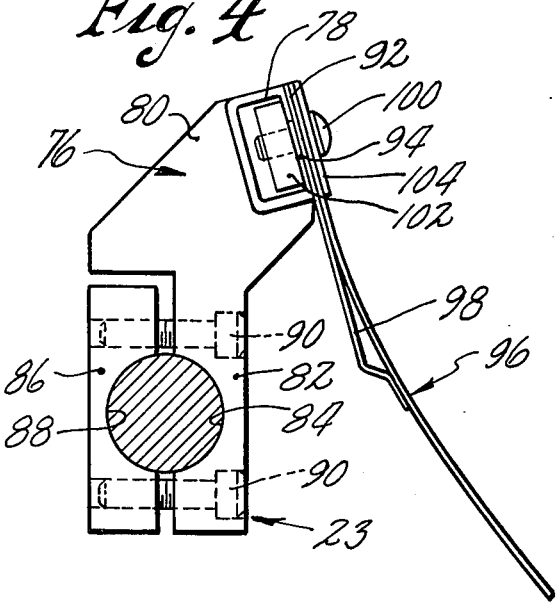
FIG. 4 is a side elevational view of a finger mount located at the upstream end of the packer grid.

As shown in FIGS. 1 and 4, the front finger mount 23 includes two spaced apart mounting posts 76 which are attached to the upstream rod 8. A track member 78 extends between the upper portions 80 of the mounting posts 76 in a direction generally parallel to the upstream rod 8. The mounting post 76 includes a downwardly extending flange 82 having an annular cutout 84 therein for engaging the rod 8. A backup plate 86 is provided having a similar cutout 88. Suitable screw members 90 are provided for attaching the backup plate to the flange whereby the mounting post 76 is held stationary with respect to the rod 8.

The track member 78 includes a forward face 92 having an elongated slot 94 therein. As shown in FIG. 4, the face 92, in cross section, is tilted with respect to the vertical. An "upstream" finger 96 may be attached to the track 78 in the manner shown in FIG. 4. If desired, a backup spring 98 may be provided in conjunction with the finger 96. The finger 96 and backup spring 98 may be provided with a suitable aperture and a bolt 100 may extend therethrough, and through the slot 94 into threaded engagement with a nut member 102 contained within the interior of the track 78. If desired, a suitable washer member 104 may be provided between the head of the bolt 100 and the outer face of the finger 96. The upstream finger 96 may be of the type including a generally elongated body portion which extends generally downwardly from the track 78 and forwardly toward the downstream end of the grid 2. If desired, the free end portion of each of the fingers 96 may be tapered as shown in FIG. 2.

With the above arrangement, the grid 2 may be readily adjusted for different pack patterns. As shown in FIG. 1, the grid 2 is arranged to pack an array of four bottles by six bottles. As can be seen, when the finger assemblies 22 include the "corner" fingers 52, the fingers 52 extend outwardly from their respective bodies 24 at an angle of generally 45° with respect to the axis of elongation of the mounting strips 12.

If it is desired to change the pattern, as for example, a three bottle by four bottle pack, the finger assemblies 22 which are not needed may be removed by removing the retaining disc 28 thereof and the front fingers 96 may be removed by unthreading the bolt 100. The remaining finger assemblies 22 may be properly spaced for the particular diameter of the bottle by merely loosening the screws 30 and sliding each finger assembly 22 along its stip 12 until it is properly spaced. The strips 12 may be adjusted for varying bottle diameters by loosening the set screw 18 and sliding the collars 14 along the rods 8 and 10.

In the event that a finger 52 becomes bent or damaged, its replacement may be achieved by either removing the entire finger assembly 22 and attaching a new one in its place, or by removing the screw 30 and cap 26 to a point where the finger can be removed from the assembly 22 whereupon a new one can be inserted and the screw 30 retightened to hold the fingers in place.

What is claimed is:

1. A finger assembly for use in a packer grid, said finger assembly comprising:

a. a body having an upper frustoconical section having at least one flat thereon;

b. at least one flexible finger extending downwardly and outwardly from said body, said finger having an upper portion positioned against said flat, said upper portion having at least one ear extending therefrom; and c. cap means attached to said body for holding the upper portion of said finger against said flat, said cap having a circumferential groove in its interior surface, the ear of said finger extending into said groove.

2. The finger assembly of claim 1 further including means for adjustably mounting said body on the grid.

3. The finger assembly of claim 1 wherein there are four flats equally spaced about the perimeter of said frustoconical section and four flexible fingers, each being associated with a different one of said flats.

4. The finger assembly of claim 1 wherein said upper section has two slots therein which intersect each other at 90°, said slots extending diametrically across said upper section, the ends of each slot adapted to receive an upper portion of a flexible finger member.

5. The finger assembly of claim 4 wherein said body has a generally cylindrical bottom portion, a frustoconical midportion, and an upper portion, said upper portion including said upper frustoconical section and a lower cylindrical portion, said lower cylindrical portion being connected to the smaller end of said frustoconial midportion.

6. The finger assembly of claim 5 wherein said bottom portion has a slot therein extending diametrically thereacross, the midplane of the slot in said bottom being coplanar with the midplane of one of said slots in said upper section.

7. A packer grid comprising:

a. a frame including two spaced apart members extending perpendicular to the packer flow;

b. a plurality of parallel elongated mounting bars, each having its ends adjustably connected to said spaced apart members, and extending generally perpendicularly to said spaced apart members; and c. a plurality of finger assemblies adjustably and removably mounted on said mounting bars, each finger assembly including:

i. a body having an upper frustoconical section having at least one flat thereon;

ii. at least one flexible finger extending downwardly and outwardly from said body and having an upper portion positioned against said flat, said upper portion having at least one ear extending therefrom; and iii. cap means attached to said body for holding the upper portion of said finger against said flat, said cap having a circumferential groove in its interior surface, the ear of said finger extending into said groove.

8. The packer grid of claim 7 wherein the body of each finger assembly includes four flats equally spaced about the perimeter of said frustoconical section, and four flexible fingers, each being associated with a different one of said flats, said fingers extending downwardly from said body and away from said body in a direction having an angle of generally 45° with respect to axis of elongation of said mounting bars.

9. The packer grid of claim 7 wherein the body of each said finger assembly has a slot in its bottom surface extending diametrically thereacross, said finger assembly being mounted on said mounting bar with said bar being received within said slot, and a retaining member removably connected to said body for clamping said finger assembly to said bar.

10. The packer grid of claim 7 further including a track member mounted adjacent the upstream end of said grid and extending parallel to said spaced apart members, and at least one finger member adjustably mounted on said track and extending downwardly from the track between two adjacent mounting bars and forwardly from said track toward the downstream end of said grid.

* * * * *